US010209649B1

(12) United States Patent
Gray

(10) Patent No.: US 10,209,649 B1
(45) Date of Patent: Feb. 19, 2019

(54) SHAPED FUSER REFLECTOR FOR EXTERNALLY HEATING A FUSER ASSEMBLY WITH VARIABLE SIZE PRINT MEDIA

(71) Applicant: Xerox Corporation, Norwalk, CT (US)

(72) Inventor: Simon John Gray, Bedford (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/880,761

(22) Filed: Jan. 26, 2018

(51) Int. Cl.
*G03G 15/20* (2006.01)

(52) U.S. Cl.
CPC ..... *G03G 15/2007* (2013.01)

(58) Field of Classification Search
CPC ..... G03G 15/2007
USPC ..... 399/328–330, 334–336
See application file for complete search history.

(56) References Cited

U.S. PATENT DOCUMENTS 7,742,733 B2 6/2010 Barton et al.
8,086,154 B2 12/2011 Law et al.
8,977,179 B2 * 3/2015 McDavid et al. . G03G 15/2007 399/334
8,977,180 B2 * 3/2015 Akuta ..... G03G 15/2007 399/336
9,037,058 B2 * 5/2015 Iwata ..... G03G 15/2053 399/329
2007/0019063 A1 1/2007 Yasuda et al.
2007/0140756 A1 6/2007 Callis et al.
2014/0376980 A1 12/2014 McDavid et al.
2017/0131637 A1 5/2017 Hofmann et al.

FOREIGN PATENT DOCUMENTS

WO 2017160320 A1 9/2017

* cited by examiner

*Primary Examiner* — William J Royer
(74) *Attorney, Agent, or Firm* — Caesar Rivise, PC

(57) ABSTRACT

A fuser apparatus includes fuser and pressure rolls rotatably mounted parallel to and in contact with each other to form a nip through which print media with a toner image thereon is passed to fuse the image to the print media. A heating lamp is positioned to heat the fuser roll. A mechanism is used that alters the interior of a fuser housing to harvest the excess heat emitted by the heating lamp and to reflect the excess heat back to the fuser roll at different patterns/angles dependent on the mode of the fusing and the size of print substrate being marked.

20 Claims, 9 Drawing Sheets

SHAPED FUSER REFLECTOR FOR EXTERNALLY HEATING A FUSER ASSEMBLY WITH VARIABLE SIZE PRINT MEDIA

BACKGROUND OF THE INVENTION

The present disclosure is related to marking and printing systems, and more particularly to a shaped fuser reflector to reflect back to heat a fuser assembly that accommodates variable print media.

In a typical xerographic image forming device, a toner image is formed on a medium such as print media, and then the toner is heated to fuse the toner on the medium. One process for thermally fusing toner onto media uses a fuser assembly including a pressure roll, a fuser roll typically hollow to accommodate a heating source, a fusing nip between the rolls, and a heating lamp in the center of the fuser roll. The heating lamp radiates heat onto the outer surface of the fuser roll or a belt. The fuser is contained within a thermally isolating housing that can reflect some of the radiated heat back to the fuser roll. The heated fuser roll or belt is pressed against the pressure roll or belt forming the fusing nip. The heating lamp extends the full width of the printing process in order to suitably heat and fuse toner to the widest print media used with the image forming device. The fusing heat is typically controlled by measuring the temperature of the fuser roll or belt and feeding the temperature information to a controlled power supply in the image forming device.

The temperature across the fuser roller has to be consistent to provide an accurate fusing. As the lamp heats the fuser roll, and the heat is transferred to the print media which cools the fuser, the temperature becomes uneven. If smaller print media sizes are fused the whole fuser is heated wasting energy. Additionally, excessive heating of components forming the fuser assembly can be very damaging. In order to prevent thermal damage, steps are taken to limit the overheating of the portion of the fuser assembly that does not contact narrower print media such as paper media sheets. Typically, the inter-page gap between successive media sheets being printed is increased when media sheets less than the full width are used. However, increasing the inter-page gap between successive media sheets slows the printing process down which may increase a customer frustration with the imaging forming device. Accordingly, an improved fuser assembly for use with printing on narrower media sheets is desired.

For the reasons stated above, and for other reasons stated below which will become apparent to those skilled in the art upon reading and understanding the present specification, there is a need in the art for concentrating fuser heat on the parts of the fuser roll needed to be heated and for lowering power consumption in a fuser assembly.

BRIEF SUMMARY OF THE INVENTION

According to aspects of the embodiments, the present disclosure relates to a fuser assembly for a xerographic image forming device that includes a rotatable fusing member forming a fusing nip with a pressure member contained in a fuser housing. A heating lamp is positioned to heat the fusing member. A mechanism is used that alters the interior of the fuser housing to harvest the excess heat emitted by the heating lamp via the fusing member and to reflect the excess heat back to the fusing member at different patterns/angles dependent on the mode of the fuser assembly and the size of print substrate being marked.

DETAILED DESCRIPTION OF THE INVENTION

Figure 1:
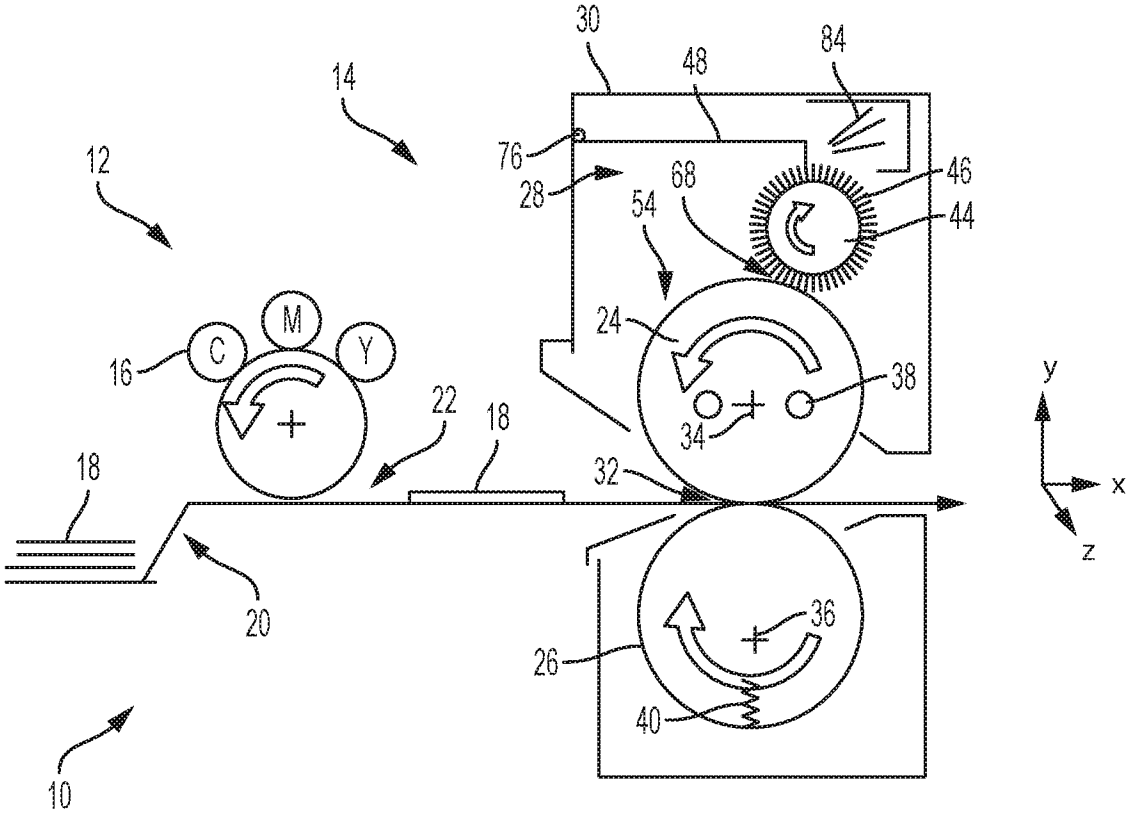
FIG. 1 RELATED ART
FIG. 1 illustrates a block diagram of a system that shows a related xerographic printing system incorporating shaped fuser reflector and radiant heating in accordance with an embodiment.

Exemplary embodiments are intended to cover all alternatives, modifications, and equivalents as may be included within the spirit and scope of the composition, apparatus and systems as described herein.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof. In the drawing, like reference numerals are used throughout to designate similar or identical elements.

In one aspect, the disclosed embodiments include a xerographic device adapted to print an image onto a copy sheet, comprising an imaging apparatus for processing and recording an image onto said copy sheet traveling in a process direction; an image development apparatus for developing the image; a transfer device for transferring the image onto said copy sheet; a fuser for fusing the image onto said copy sheet, said fuser including a fuser roll and a pressure roll that forms a nip therebetween through which said copy sheet is conveyed in order to permanently fuse the image onto said copy sheet; a radiant heater spaced from and facing an inner surface of the fuser roll; wherein the radiant heater is adapted to emit radiant heat onto the inner surface of the fuser roll to directly heat the inner surface to increase the temperature of an outer surface of the fuser roll opposite the inner surface heated by the radiant heater; a textured region coupled to a substrate and positioned to interact with the emitted radiant heat, wherein the textured region includes surface features sized and positioned to facilitate reflection at an angle a portion of the emitted radiant heat; and a mask region with transmitting apertures positioned between the textured region and the outer surface of the fuser roll, the mask region being positioned such that incoming radiant heat passes through the transmitting apertures before contacting the textured region.

The disclosed embodiments further include a xerographic device wherein when the textured region and the mask region move between an overlapping relationship with respect to one another along an optical axis the surface features are visible through the transmitting apertures in the mask region.

The disclosed embodiments further include a simple reflective fuser housing where a xerographic device causes the textured region and the mask region to move to a closed position where the surface features are not visible through the transmitting apertures in the mask region. Further, the closed position corresponds to a non-overlapping relationship with respect to one another along an optical axis.

The disclosed embodiments include apparatus useful in processing a sheet comprising a fuser roll defining the inner surface and an outer surface; a radiant heater spaced from and facing the inner surface of the fuser roll; wherein the radiant heater is adapted to emit radiant heat onto the inner surface of the fuser roll to directly heat the inner surface to increase the temperature of the outer surface of the fuser roll opposite the inner surface heated by the radiant heater; a textured region coupled to a substrate and positioned to interact with the emitted radiant heat, wherein the textured region includes surface features sized and positioned to facilitate reflection at an angle a portion of the emitted radiant heat; and a mask region with transmitting apertures positioned between the textured region and the outer surface of the fuser roll, the mask region being positioned such that incoming radiant heat passes through the transmitting apertures before contacting the textured region.

The disclosed embodiments include a method of fusing toner onto a medium in a xerographic apparatus comprising a pressure roll and fuser roll including an inner surface and an outer surface opposite the inner surface, the method comprising heating the inner surface of the fuser roll to directly heat the inner surface to increase the temperature of the outer surface of the fuser roll opposite the inner surface by using a radiant heater with one or more light sources adapted to emit electromagnetic radiation (EEMR); and harvesting the emitted electromagnetic radiation for auxiliary heat by: using a textured region coupled to a substrate and positioned to interact with the EEMR, wherein the textured region includes surface features sized and positioned to facilitate reflection at an angle a portion of the EEMR; using a mask region with transmitting apertures positioned between the textured region and the outer surface of the fuser roll, the mask region being positioned such that incoming EEMR passes through the transmitting apertures before contacting the textured region.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

Although embodiments of the invention are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. For example, "a plurality of stations" may include two or more stations. The terms "first," "second," "initial", "another" and the like, herein do not denote any order, quantity, or importance, but rather are used to distinguish one position from another. The terms "a" and "an" herein do not denote a limitation of quantity, but rather denote the presence of at least one of the referenced item.

For illustrative purposes, although the term 'fuser roll' is herein used, it will be understood that the term can apply to any roll of the recited structure, used in a printing or sheet-processing operation, and is not restricted to xerographic fusing. Further, the term "fuser" also encompasses members useful for a printing process or in a printing system including, but not limited to, a fixing member, a pressure member, a heat member, and/or a donor member. In various embodiments, the fuser can be in a form of, for example, a roller, a cylinder, a belt, a plate, a film, a sheet, a drum, a drelt (cross between a belt and a drum), or other known form for a fuser member. A "fuser", as described and claimed herein, may be adapted to be useful in other types of printing, such as solid-inkjet printing, iconography, xerography, flexography, offset printing, and the like.

The term "image forming device" or "printing system" as used herein refers to a digital copier or printer, scanner, image printing machine, digital production press, document processing system, image reproduction machine, bookmaking machine, facsimile machine, multi-function machine, or the like and can include several marking engines, feed mechanism, scanning assembly as well as other print media processing units, such as paper feeders, finishers, and the like. The printing system can handle sheets, webs, marking materials, and the like. A printing system can place marks on any surface, and the like and is any machine that reads marks on input sheets; or any combination of such machines.

As used herein, the term "xerography" is understood as comprising a process producing at least one copy of an electrostatically charged image on a substrate or carrier, i.e., a sheet of paper. Xerography is then any printing operation in which marking material, typically but not necessarily a dry toner, associated with one or more images is transferred to a copy sheet (print sheet) by electrostatic forces in a printing system.

The term "print media" generally refers to a usually flexible, sometimes curled, physical sheet of paper, substrate, plastic, or other suitable physical print media substrate for images, whether precut or web fed.

Further as to the matter of heating, the term "primary" refers to providing more than "X" percent such as 50%, and up to and including 100%, of the heat energy employed for fusing toner to the print media on which it resides. Correspondingly, the term "secondary" or "auxiliary" refers to providing less than "X" percent of the heat energy.

In the following description, reference is made to the accompanying drawings where like numerals represent like elements.

Referring now to the drawings, and more particularly to FIG. 1, there is shown a schematic view of an example of an electrophotographic printing system 10 which includes an image applying component 12, which applies a toner image to print media by the steps of latent image formation, development, and transfer, and a fusing system 14, which fuses the applied image to the print media. The image applying component 12 includes one or more toner sources 16, such as cyan, magenta, and yellow (C, M, and Y) in the illustrated embodiment, and may employ conventional xerographic techniques, as known in the art. Print media 18 is conveyed to the image applying component 12 from a print media source 20, such as one or more trays, by a conveyor system 22. The conveyor system 22 also transports print media with toner images thereon from the image applying component 12 to the fusing system 14 in the processing direction, indicated by arrow x. The exemplary printing system 10 may include a variety of other components, such as finishers, paper feeders, and the like, and may be embodied as a copier, printer, bookmaking machine, facsimile machine, or a multifunction machine, and controller (not shown) for controlling the system 10 and the fusing system (fuser assembly) 14 in accordance with instructions or logic supplied through an input/output device such as a user interface.

The fusing system 14 (or simply "fuser") generally includes first and second tangentially rotating rolls, namely a fuser roll 24 and a pressure roll 26, and a cleaning system 28. The fuser roll 24 and pressure roll 26 are rotatably mounted in a fuser housing 30—the housing is usually made of hard plastic or metal—and are aligned parallel to and in contact with each other to form a nip 32 through which the print media 18, with a toner image thereon (not shown) is passed, as in the direction of arrow x. The fuser roll 24 and pressure roll 26 are rotated about respective axes of symmetry 34, 36 aligned generally perpendicular with the process direction, in the direction of arrow z. The fuser roll 24 is heated by a heating system 38, illustrated as a pair of heat lamps aligned parallel to the axis 34 of the fuser roll 24. A drive system rotates the fuser and pressure rolls 24, 26 in the directions shown in FIG. 1. For example, the fuser roll 24 may be driven at about 300 mm per second. The pressure roll 26 is urged into contact with the fuser roll 24 by a constant spring force, indicated by arrow 40.

The fuser roll 24 may include a rigid cylindrical sleeve, formed from aluminum or other suitable metal that is hollow and has a wall thickness about 5 mm, or less. The pressure roll 26 may include a cylindrical conformable roll, which includes a metal core, such as steel, with a layer of silicone rubber or other conformable material on its outer surface that is covered by a conductive heat resistant material, such as Teflon®. As the paper with the toner image is passed through the nip 32, the toner image melts and is permanently fused to the paper. Mechanical stripper fingers (not shown), downstream of the nip 32, ensure that the paper with the permanent image is prevented from sticking to the fuser roll 24 and is transported through the nip 32.

The cleaning system 28 includes a rotatable cleaning member in the form of a cylindrical cleaning roll 44, which contacts one of the fuser and pressure rolls, 24, 26 at a location spaced from the nip 32. The contacted roll is the heated fuser roll 24 in the illustrated embodiment and will be described as such in the following description, although it is to be appreciated that the description could apply analogously to the pressure roll 26. The cleaning roll 44 includes a pile 46, which forms an outer surface of the cleaning roll 44 as a cleaning member engages the fuser roll 24 at nip 68. A flicker bar 48 engages the cleaning roll 44 and dislodges toner 84 from the pile 46. The flicker bar 48 can be mounted at an end 76 of a second portion, for example, to the fuser housing 30 of the fuser system 14 or other rigid support surface.

The heating system 38 is illustrated as a pair of heat lamps aligned parallel at an upstream end and a downstream end. In embodiments, the heating system 38 includes at least one radiant energy source that emits radiant heat onto the fuser roll 24. The radiant heat emitted by the radiant energy source(s) heat(s) a portion of the fuser roll 24 to a desired temperature. The radiant energy source can be any suitable source that can emit an effective amount of radiant heat onto an inner surface of the fuser roll 24, within the desired period of time, to heat the desired portion of an outer surface 54 of the fuser roll 24 to the desired temperature. The heat lamps or heating system 38 can include at least one of an ultraviolet (UV) lamp, a xenon lamp, a halogen lamp, a laser array, a light emitting diode (LED) array, and an organic light emitting diode (OLED) array. The heat source 38 can be adapted to emit electromagnetic radiation (EEMR) in the form of infra-red (IR) light rays and ultraviolet (UV) light rays towards the inner surface of fuser roll 24.

Heating system 38 uniformly heats fuser roll 24 along the entire length. As discussed above, when printing media that is narrower than the widest media supported by printing system (image forming device) 10, the portion of fuser roll 24 beyond the width of the media does not lose heat through the sheet and becomes hotter than the portion of fuser roll 24 that contacts the media sheet. What is needed is a way to focus/redirect the light rays (emitted heat) on the portion of the fuser roll 24 that touches the media sheet so as to achieve a uniform temperature by the time the portion of the fuser roll 24 reaches the downstream heating lamp.

The fuser assemblies typically contain the fuser roll (hollow roller) 24 containing the heating system (heat lamp) 38 to cause the outer surface/skin to get hot so that toner on the print media 18 can be fused as it passes through a nip 32 created with the pressure roll 26. The heating system 38 is shown as a lamp positioned in the inside of fuser roll 24 to supply radiant heat to fuser roll 24 to maintain fuser roll 24 within a desired temperature range. The heated fuser roll 24 fuses the toner to print media 18 passing through nip 32. In one embodiment, heating system 38 includes a halogen bulb that extends substantially the entire axial length of fuser roll 24 from a first end of fuser roll 24 to a second end.

Next, an embodiment of the present invention will be described. Note that portions which are the same as those in prior embodiments described above are denoted by the same reference numerals, and descriptions of the same portions as those as in the first embodiment will be omitted. Further with FIG. 2 and in accordance to an embodiment, a reflective material is shown affixed to the inner skin of a housing 30 of the reproduction device. As will be explained below the reflective material can be shaped and positioned to harvest errand electromagnetic radiation like from heating system 38 to form an auxiliary heat source that can be concentrated on any parts of the fusing rolls like fuser roll 24.

Figure 2:
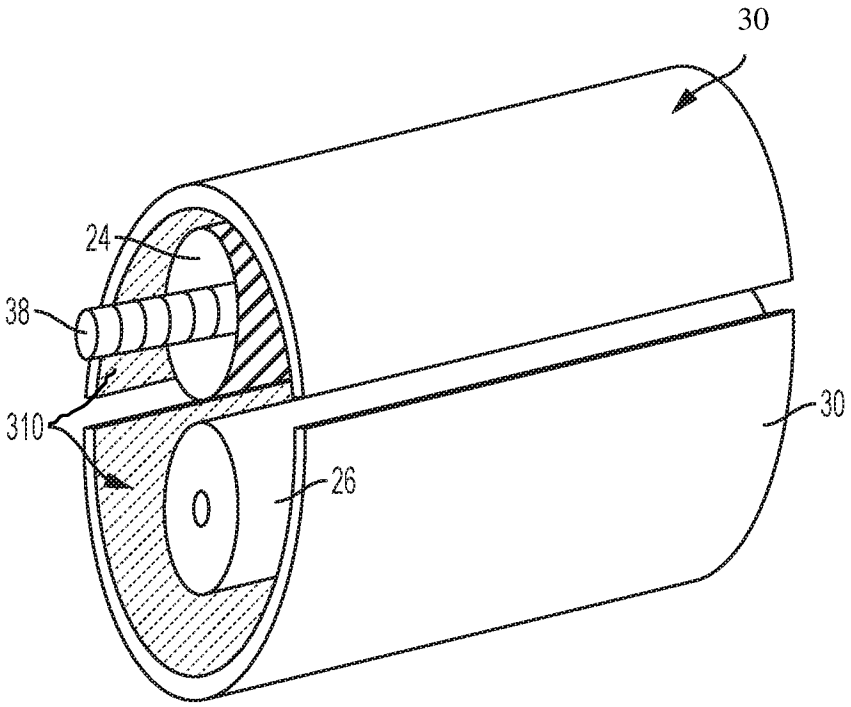
FIG. 2 illustrates fuser and pressure rolls with a simple fuser reflector housing to harvest excess heat in accordance to an embodiment.

FIG. 2 illustrates fuser and pressure rolls 24, 26 with shaped fuser reflector 310 to harvest excess heat in accordance to an embodiment. The shaped fuser reflector 310 can be visualized as the housing 30 as flat with two reflective sheets, reflector and mask. Fuser roll 24 includes at least a first and primary heating source or heating system 38, and a second and secondary heating source in the shaped fuser reflector 310. Therefore the reflected heat across the fuser from shaped fuser reflector 310 can be more focused so only the parts needed to be heated are heated and the energy used can be minimized meeting the need in the art for lower power consumption in a fuser assembly.

The shaped fuser reflector 310 is shown as reflective material that uses the inner skin of housing 30 as a substrate and the reflective materials are positioned to interact with the heat emitted by heating system 38. The inside of the housing 30 can reflect heat back towards the fuser to help heating and so the fuser system 14 does not waste energy. The idea is to make shaped reflective patterns on the inside of the fuser housing (reflector) 30 to reflect the heat back to the rollers at varying angles. Shaped fuser reflector 310 extends along the axial length of fuser roll 24 so as to be able to reflect the heat back on the entire fuser roll 24 if is so desired. As it will be explained below the shaped fuser reflector 310 is a textured region having surface features sized and positioned to facilitate reflection at an angle a portion of the emitted radiant heat onto the outer surface 54 of fuser roll 54.

Figure 3A:
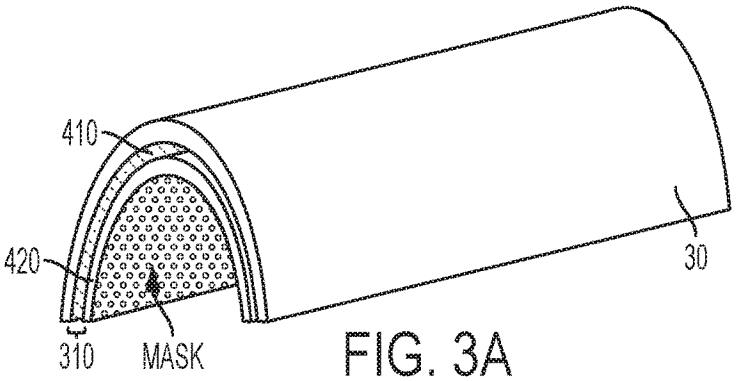
FIG. 3A illustrates the elements forming a shaped fuser reflector useful in harvesting excess heat emitted by a fuser and to reflect this back to the fuser roll in accordance to an embodiment.

FIG. 3A illustrates the elements forming a shaped fuser reflector 310 useful in harvesting excess heat emitted by the fuser and to reflect this back to the fuser roll 24 in accordance to an embodiment. Note that portions which are the same as those in prior embodiments described above are denoted by the same reference numerals, and descriptions of the same portions as those as in the first embodiment will be omitted. As shown the shaped fuser reflector 310 comprises a reflector 410 to reflect the heat back to the rollers 24,26 at varying angles and a thin reflective sheet 420 called a mask containing shaped holes or apertures in-between (FIGS. 5-8). The emitted radiant heat such as infra-red (IR) can pass through the apertures and is then reflected back dependent on the pattern or surface regions exposed by the apertures in the mask.

Figure 3B:
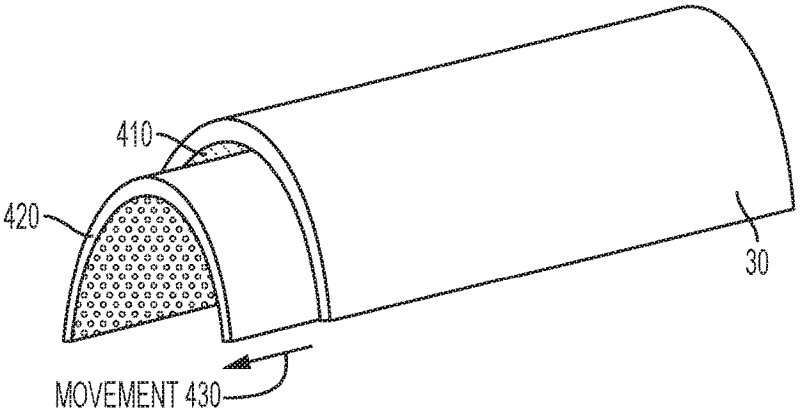
FIG. 3B illustrates relative movement of the elements forming a shaped fuser reflector to harvest excess and waste heat in accordance to an embodiment.

FIG. 3B illustrates relative movement of the elements forming a shaped fuser reflector to harvest excess heat in accordance to an embodiment. Note that portions which are the same as those in prior embodiments described above are denoted by the same reference numerals, and descriptions of the same portions as those as in the first embodiment will be omitted. As shown, the thin reflective sheet or mask 420 is movable (movement 430) between an initial position and another position where reflected light rays cover a segment of fuser roll 24. Any suitable actuation mechanism may be used to move mask 420 toward and away from end of fuser roll 24 or to cover or uncover certain surface features on the reflector 410. For example, mask 420 may be driven by an electric motor and gear system, manually by an operator, or actuated by a solenoid. Mask 420 is selectively movable between the initial position and the final position including positions intermediate these positions to allow harvesting of the emitted electromagnetic radiation for auxiliary heat such as IR heat and can direct this in different patterns. For example, the patterns can be based on the size and shape of the print media 18 being fused and likewise the pattern can be so positioned to heat end segments of the rolls to maintain or prevent huge temperature differences along the outer surfaces of the rolls. This harvested auxiliary heat can be focus along the length of the rolls or due to the geometry and orientation of the surface features can be redirected to the cooled portion of the rolls 24, 26 for example: where the print media 18 passed through nip 32 formed by the fuser and pressure rolls.

Figure 4:
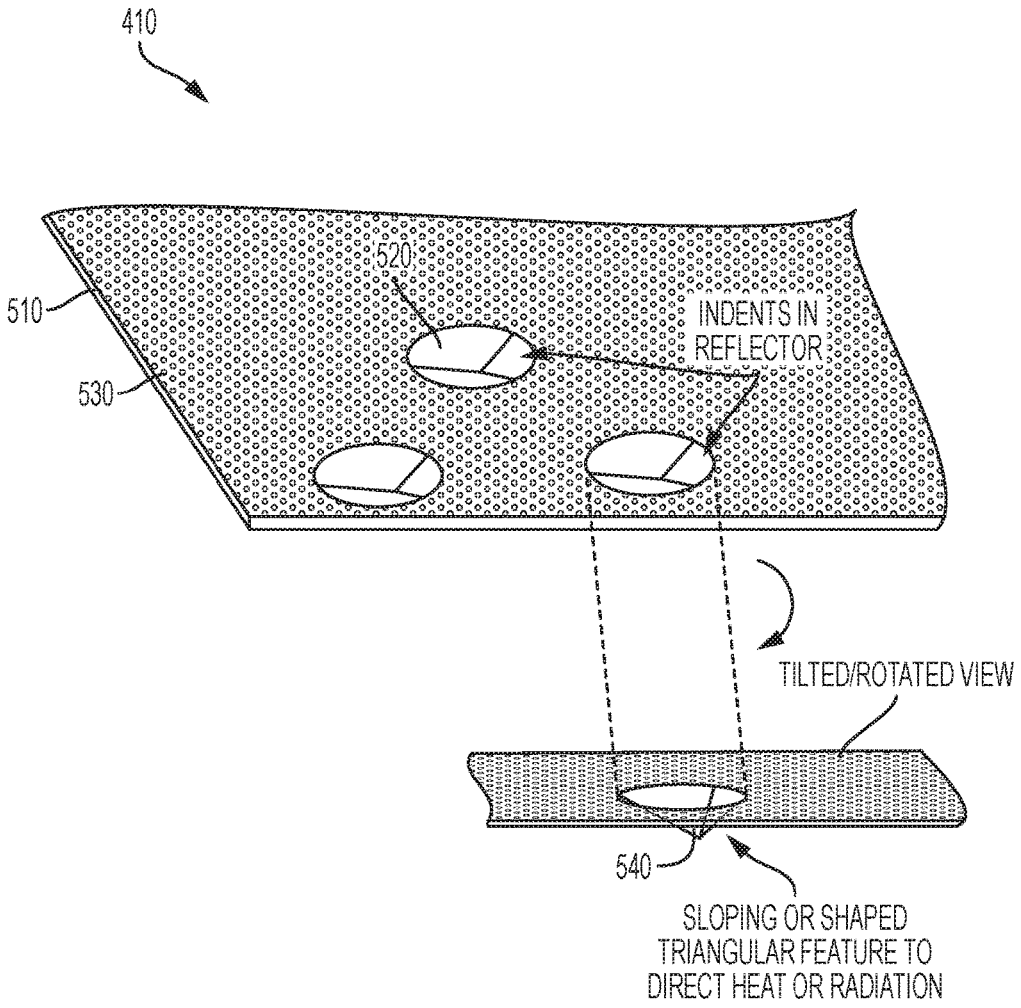
FIG. 4 illustrates a texture region of a reflector element forming a shaped fuser reflector to harvest excess heat in accordance to an embodiment.

FIG. 4 illustrates the texture region of the reflector 410 forming a shaped fuser reflector 310 to harvest excess heat in accordance to an embodiment. Reflector 410 comprises a textured region 510 coupled to a substrate like housing 30 with surface features 520 like a mirror that is sized and positioned to facilitate reflection at an angle (angular reflection) a portion of the emitted radiant heat and substantially flat surface 530 that reflects the emitted radiant at the incidence angle, i.e., no angular reflection. As shown, texture region 510 has minute pits like surface feature 520 and protrusions 540 formed thereon. The pits and protrusions are formed at opposite ends from each other. The surface features can be made on reflector (substrate) 410 by depositing a layer of tiny refractive structures on it or by creating indents such as small pyramid like structures. The indents would create surface features that would be inward making it easier to slide/position the mask for different configurations. Such surface features can be micron-sized and/or nano-sized, and can be any shape or configurations. Non-limiting examples of such shapes and configurations include sloping, pyramidal, inverted pyramidal, spherical, square, rectangular, triangular, parabolic, ellipsoidal, asymmetric, symmetric, cones, inverted pillars, inverted cones, microlenses, and combinations thereof.

Figure 5:
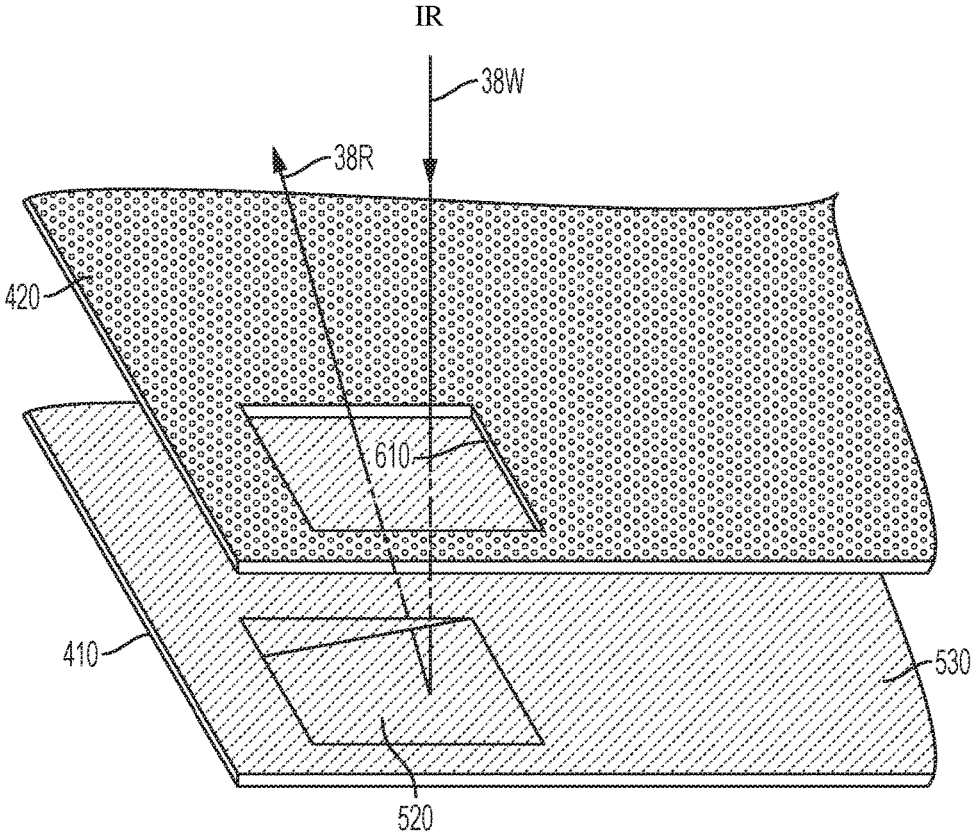
FIG. 5 illustrates elements of the shaped fuser reflector positioned to facilitate reflection at an angle a portion of an emitted radiant heat in accordance to an embodiment.

FIG. 5 illustrates elements of the shaped fuser reflector 310 positioned to facilitate reflection at an angle a portion of an emitted radiant heat in accordance to an embodiment. The reflector 410 and mask 420 are shown in an overlapping relationship (second position) with respect to one another along an optical axis the surface features 520 are visible through transmitting apertures 610 in the mask 420. In such an overlapping position the incoming radiation 38W enters apertures 610 and exits apertures 610 at a different angle. Surface features 520 is illustrated as an inward slopping rectangular structure with triangular walls to enable the reflector/mask sheets to move smoothly in relation to one another. Radiation 38W emanating from the heating system 38, located in a first focal point ($F_1$) towards the reflector 410 and the reflected radiation 38R, reflected by surface features 520 towards a second focus point ($F_2$), is depicted by line arrows in the drawing. The direction of $F_2$ can be manipulated based on the size, shape, and orientation of the surface features 520. For example, to enable the reflected radiation 38R to be directed to the center of rolls 24, 26 the reflector pattern or surface features 520 on one end would have the opposite angle to the other end.

Figure 6:
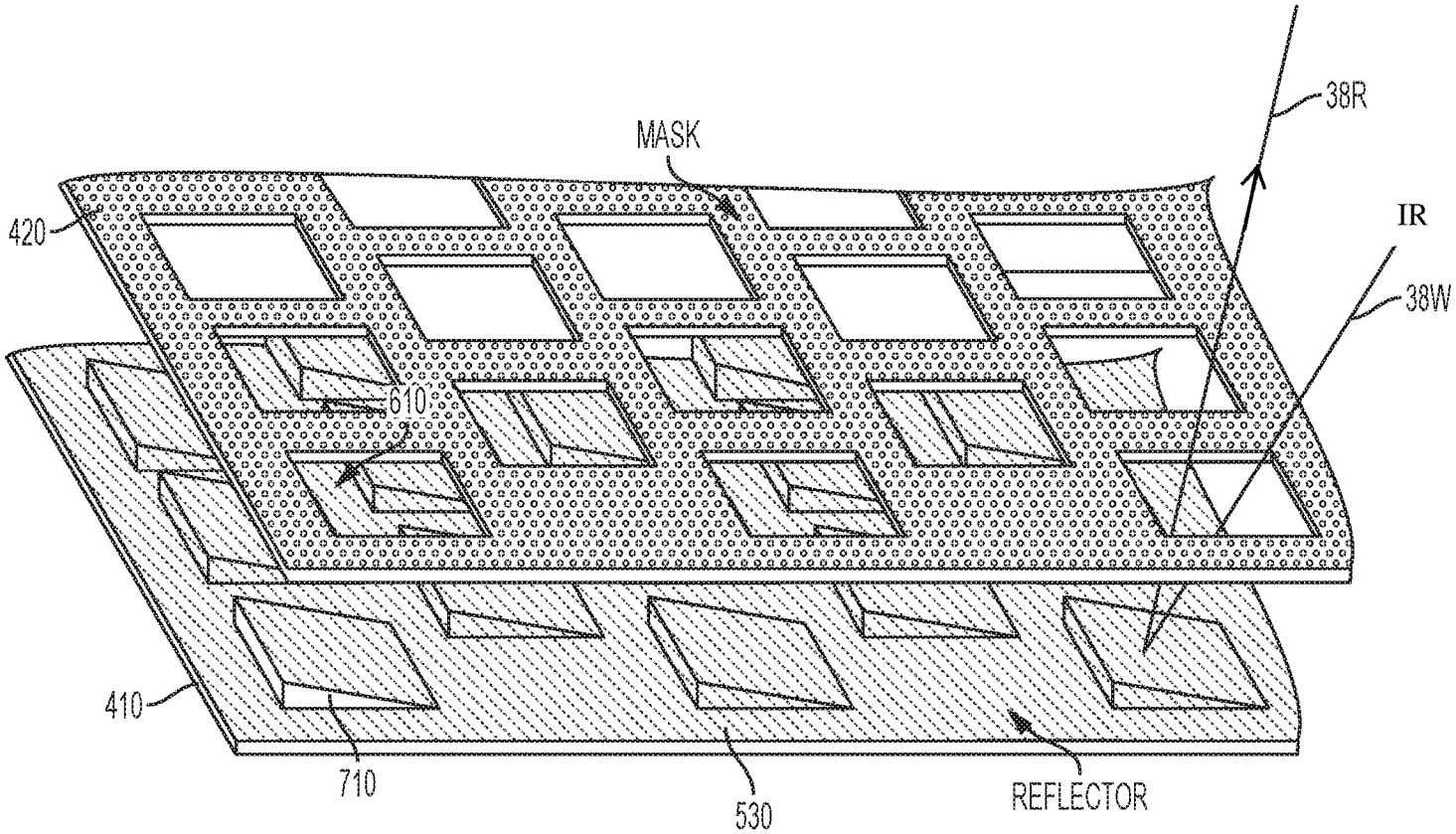
FIG. 6 illustrates elements of the shaped fuser reflector positioned with surface features to facilitate reflection at an angle a portion of an emitted radiant heat in accordance to an embodiment.

FIG. 6 illustrates elements of the shaped fuser reflector 310 positioned with surface features to facilitate reflection at an angle a portion of an emitted radiant heat in accordance to an embodiment. Note that portions which are the same as those in prior embodiments described above are denoted by the same reference numerals, and descriptions of the same portions as those as in the first embodiment will be omitted. The reflector 410 and mask 420 are shown in an overlapping relationship (second position) with respect to one another along an optical axis and surface features 710 are visible through the transmitting apertures 610 in the mask 420. Surface features 710 are shown as a protruding or inclined triangular reflective surface. Surface feature 710 denotes a reflective element layer on which ramp reflective elements of the present invention are arranged in a close-packed state on reflector 410. As shown in both FIG. 6 and FIG. 7 the apertures 610 are in a position where the transmitting apertures 610 will reflect an incoming electromagnetic signal such as an IR light at an angle.

Figure 7:
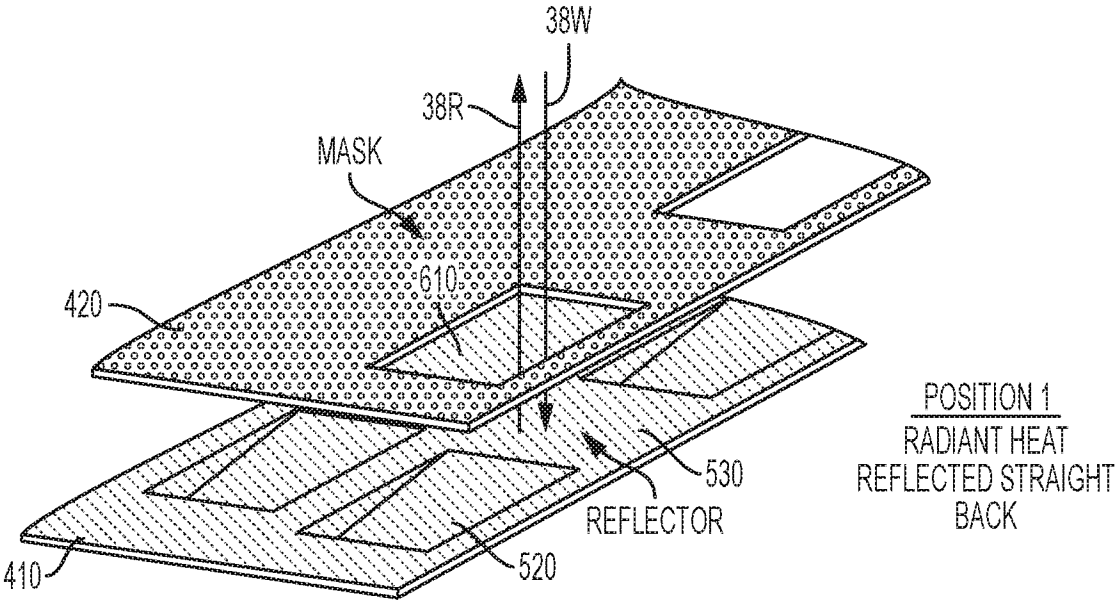
FIG. 7 illustrates elements of the shaped fuser reflector at an initial position to facilitate reflection of an emitted radiant heat in accordance to an embodiment.

FIG. 7 illustrates elements of the shaped fuser reflector 310 at a first position to facilitate reflection of an emitted radiant heat in accordance to an embodiment. Note that portions which are the same as those in prior embodiments described above are denoted by the same reference numerals, and descriptions of the same portions as those as in the first embodiment will be omitted. As illustrated here the apertures on mask 420 are in a closed position, i.e., position 1, which corresponds to a non-overlapping relationship with respect to one another along an optical axis. In the closed position the features on the reflective sheet do not form part or are within the optical path of the heat rays from heating system 38. When the mask 420 and reflector sheet 410 are aligned normally it forms a flat infrared (IR) reflector as the incoming radiation 38W passing through the holes/apertures 610 in the mask 420 are simply reflected 38R straight back by the reflector 410. It is similar to having just a single flat sheet reflecting the infra-red (IR). In this case, incoming radiation 38W is reflected back at the same angle as the incoming radiation 38W.

Figure 8:
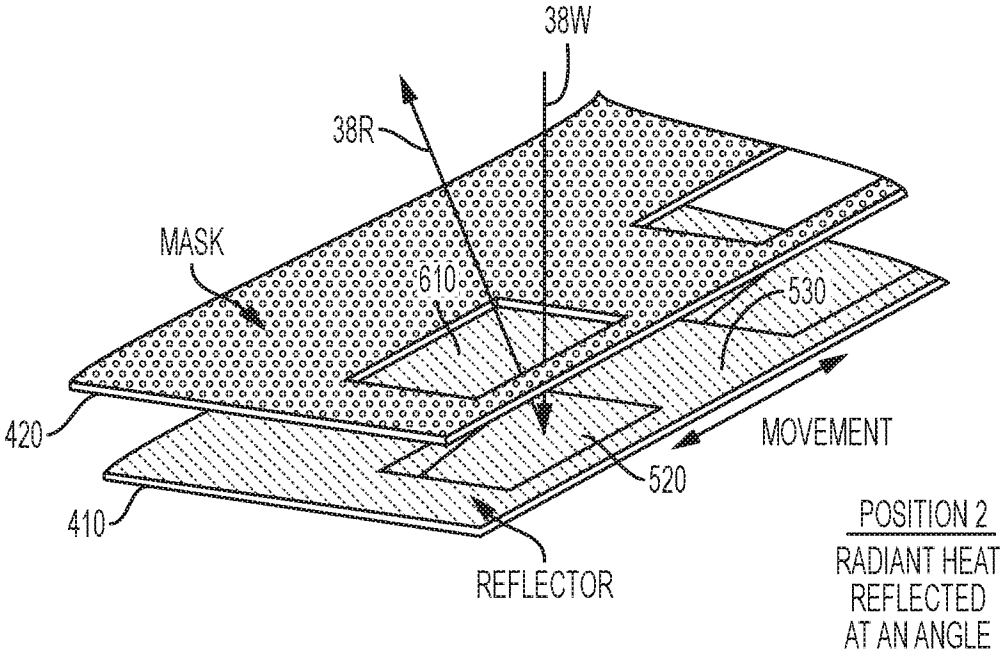
FIG. 8 illustrates elements of the shaped fuser reflector at another position to facilitate reflection of an emitted radiant heat in accordance to an embodiment.

FIG. 8 illustrates elements of the shaped fuser reflector 310 at a second position to facilitate reflection of an emitted radiant heat in accordance to an embodiment. Note that portions which are the same as those in prior embodiments described above are denoted by the same reference numerals, and descriptions of the same portions as those as in the first embodiment will be omitted. As illustrated here the apertures on mask 420 are in an open position, i.e., position 2, which corresponds to an overlapping relationship with respect to one another along an optical axis. When the reflector 410 is moved horizontally to the mask 420, the surface features (inner surface or angled parts) 520 are visible through the apertures/holes 610 in the mask 420, the infra-red will be reflected at an angle back through the hole in the mask 420. To enable the sheets to move smoothly in relation to one another the angled parts 520 can be placed away from the mask 420—as in the example with single hole above. In this case incoming radiation 38W emanating from the heating system 38 interact with the surface features 520 of reflector 410 and is reflected back at a different angle from the incoming radiation 38W.

Figure 9:
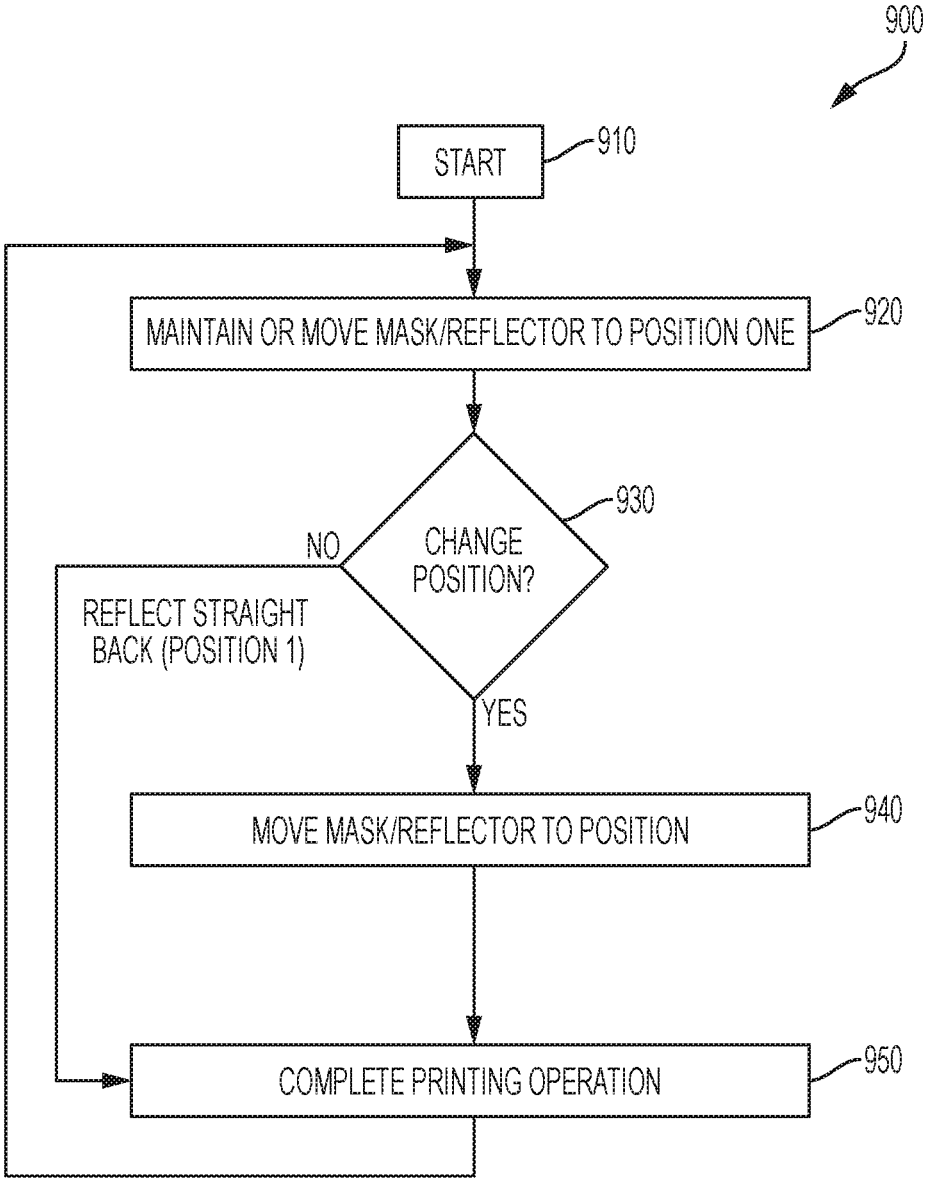
FIG. 9 illustrates a method for auxiliary heating a fuser roll with a shaped fuser reflector in accordance to an embodiment.

FIG. 9 illustrates a method 900 for auxiliary heating a fuser roll with a shaped fuser reflector in accordance to an embodiment.

Method 900 begins at 910 (start) when it is invoked at start up by printing system 10, at the start of a print job, or as selected based on print job characteristics such as paper size or media type, or based on monitored conditions such as fuser temperature across the rolls 24, 26.

In action 920, the pattern is positioned or maintained flat such that the heat is reflected straight back to the roller as per the previous diagram (position 1) shown in FIG. 7. Various positions are possible by moving the mask 420 relative to the reflective. For example for large print media where all or most of the rolls need to be heated then placing the mask at position 1 would be better because the heat is reflected straight back across the rolls. However, when small papers that is being fed at the center then reflection towards the middle of the rolls is preferable and we can call this position 2. In the event that the small paper is being fed at the margins of the rolls, like right or left justified, reflection at the margins would be more appropriate we can call these positions 3 and 4 or other designation. There are myriad of heating patterns and the mask could be placed or the surface features 520 could be shaped or focused to accommodate any predetermined pattern.

In action 930, the method determines if the position of the mask 420 is to be kept at the default position like position 1 which reflects the heat straight back or there is a change in position based media characteristics or monitored conditions. If action 930 determines that the mask 420 should be kept at position 1 then control is passed to action 950 where the printing operation is completed. As used herein, the printing operation could be the printing of a single print media or the completion of a print job or any combination thereof. If action 930 determines that there is to be a change in mask position then control is passed to action 940 for further processing.

In action 940, the correct position is selected for example when the paper size is smaller than the width of fuser roll 24, hence the paper cools just the center of the fuser roll 24, therefore the reflector 410 is moved to position 2 so as to reflect infra-red (IR) to the center or middle of the fuser roll 24 or other component of the printing system 10. In effect concentrating the heat on the small area which is required for fusing the small size paper. To enable the IR to be directed to the center the reflector pattern on one end would have the opposite angle to the other end. The method in action 950 completes the print job/operation before returning the method back to action 920 where the sheets are positioned to reflect radiated heat straight back to the outer surface of fuser roll 24.

Different reflector patterns are possible and can be accommodated by positioning of the surface features 520 to reflect at different parts of the rolls 24, 26. For example, because heat may be lost from ends of the housing 30 or ends of rolls 24, 26 (i.e., axial temperature droop) surface features can return or reflect radiated heat at the end portions of fuser roller 24, reducing heat flow from the end portions, and thereby facilitate sustaining the temperature of the end portions relative to the center portion of the fuser roller 24 to minimize the temperature differential between the end portions and the center portion. Surface features could be positioned, sized, or removed so that under different mask positions heat will always be reflected towards the portion of the rolls. Likewise the reflected/radiated heat could be directed to the front for front registered system or to the margins of the rolls (ends) for left/right registered systems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A xerographic device adapted to print an image onto a copy sheet, comprising:

an imaging apparatus for processing and recording an image onto said copy sheet traveling in a process direction;

an image development apparatus for developing the image;

a transfer device for transferring the image onto said copy sheet;

a fuser for fusing the image onto said copy sheet, said fuser including a fuser roll and a pressure roll that forms a nip therebetween through which said copy sheet is conveyed in order to permanently fuse the image onto said copy sheet;

a radiant heater spaced from and facing an inner surface of the fuser roll; wherein the radiant heater is adapted to emit radiant heat onto the inner surface of the fuser roll to directly heat the inner surface to increase the temperature of an outer surface of the fuser roll opposite the inner surface heated by the radiant heater;

a textured region coupled to a substrate and positioned to interact with the emitted radiant heat, wherein the textured region includes surface features sized and positioned to facilitate reflection at an angle a portion of the emitted radiant heat; and a mask region with transmitting apertures positioned between the textured region and the outer surface of the fuser roll, the mask region being positioned such that incoming radiant heat passes through the transmitting apertures before contacting the textured region.

2. The xerographic device of claim 1, wherein the radiant heater comprises at least one light source being operative to emit radiant heat.

3. The xerographic device of claim 2, wherein when the textured region and the mask region move between an overlapping relationship with respect to one another along an optical axis the surface features are visible through the transmitting apertures in the mask region.

4. The xerographic device of claim 3, wherein in the overlapping relationship the radiant heat will be reflected at an angle back through the transmitting apertures in the mask region.

5. The xerographic device of claim 4, wherein the at least one light source comprises one or more of a UV lamp, a xenon lamp, a halogen lamp, a laser array, a light emitting diode array, and an organic light emitting diode array.

6. The xerographic device of claim 3, wherein the surface features include a member selected from the group consisting of sloping, pyramidal, inverted pyramidal, spherical, square, rectangular, triangular, parabolic, ellipsoidal, asymmetric, symmetric, cones, inverted pillars, inverted cones, microlenses, and combinations thereof.

7. The xerographic device of claim 2, wherein when the textured region and the mask region move to a closed position the surface features are not visible through the transmitting apertures in the mask region, and wherein the closed position corresponds to a non-overlapping relationship with respect to one another along an optical axis.

8. The xerographic device of claim 7, wherein the closed position the radiant heat will be reflected straight back through the transmitting apertures in the mask region.

9. The xerographic device of claim 2, wherein the emitted radiant heat is infrared electromagnetic radiation and wherein before printing an image onto the copy sheet the mask region is in an initial position to reflect straight back onto the fuser roll.

10. The xerographic device of claim 9, wherein during printing an image onto the copy sheet the mask region is in another position to concentrate the infrared electromagnetic radiation onto the copy sheet as it passes through the fuser roll.

11. An apparatus useful in processing a copy sheet, comprising:

a fuser roll defining an inner surface and an outer surface;

a radiant heater spaced from and facing the inner surface of the fuser roll; wherein the radiant heater is adapted to emit radiant heat onto the inner surface of the fuser roll to directly heat the inner surface to increase the temperature of the outer surface of the fuser roll opposite the inner surface heated by the radiant heater;

a textured region coupled to a substrate and positioned to interact with the emitted radiant heat, wherein the textured region includes surface features sized and positioned to facilitate reflection at an angle a portion of the emitted radiant heat; and a mask region with transmitting apertures positioned between the textured region and the outer surface of the fuser roll, the mask region being positioned such that incoming radiant heat passes through the transmitting apertures before contacting the textured region.

12. The apparatus of claim 11, wherein the radiant heater comprises at least one light source being operative to emit radiant heat.

13. The apparatus of claim 12, wherein when the textured region and the mask region move between an overlapping relationship with respect to one another along an optical axis the surface features are visible through the transmitting apertures in the mask region.

14. The apparatus of claim 13, wherein in the overlapping relationship the radiant heat will be reflected at an angle back through the transmitting apertures in the mask region.

15. The apparatus of claim 14, wherein the at least one light source comprises one or more of a UV lamp, a xenon lamp, a halogen lamp, a laser array, a light emitting diode array, and an organic light emitting diode array.

16. The apparatus of claim 13, wherein the surface features include a member selected from the group consisting of sloping, pyramidal, inverted pyramidal, spherical, square, rectangular, triangular, parabolic, ellipsoidal, asymmetric, symmetric, cones, inverted pillars, inverted cones, microlenses, and combinations thereof.

17. The apparatus of claim 12, wherein when the textured region and the mask region move to a closed position the surface features are not visible through the transmitting apertures in the mask region, and wherein the closed position corresponds to a non-overlapping relationship with respect to one another along an optical axis.

18. The apparatus of claim 17, wherein the closed position the radiant heat will be reflected straight back through the transmitting apertures in the mask region.

19. The apparatus of claim 12, wherein the emitted radiant heat is infrared electromagnetic radiation and wherein before printing an image onto the copy sheet the mask region is in an initial position to reflect straight back onto the fuser roll; wherein during printing an image onto the copy sheet the mask region is in a another position to concentrate the infrared electromagnetic radiation onto the copy sheet as it passes through the fuser roll.

20. A method of fusing toner onto a medium in a xerographic apparatus comprising a pressure roll and fuser roll including an inner surface and an outer surface opposite the inner surface, the method comprising:

heating the inner surface of the fuser roll to directly heat the inner surface to increase the temperature of the outer surface of the fuser roll opposite the inner surface by using a radiant heater with one or more light sources adapted to emit electromagnetic radiation (EEMR); and harvesting the emitted electromagnetic radiation for auxiliary heat by:

using a textured region coupled to a substrate and positioned to interact with the EEMR, wherein the textured region includes surface features sized and positioned to facilitate reflection at an angle a portion of the EEMR;

using a mask region with transmitting apertures positioned between the textured region and the outer surface of the fuser roll, the mask region being positioned such that incoming EEMR passes through the transmitting apertures before contacting the textured region;

wherein the EEMR is infrared electromagnetic radiation and wherein before printing an image onto the medium the mask region is in a first position to reflect straight back onto the fuser roll.

* * * * *